US006143038A

United States Patent [19]

Yamamoto et al.

[11] Patent Number: 6,143,038

[45] Date of Patent: Nov. 7, 2000

[54] AGENTS FOR AND METHODS OF PROCESSING SYNTHETIC FIBERS

[75] Inventors: Hisao Yamamoto; Fumihiko Kimura; Masahiro Nagaya; Yukiko Kitagawa, all of Aichi, Japan

[73] Assignee: Takemoto Yushi Kabushiki Kaisha, Aichi, Japan

[21] Appl. No.: 09/479,330

[22] Filed: Jan. 6, 2000

Related U.S. Application Data

[63] Continuation-in-part of application No. 09/238,208, Jan. 27, 1999, abandoned.

[30] Foreign Application Priority Data

Apr. 27, 1998 [JP] Japan ..... 10-134575

[51] Int. Cl.[7] ..... D06M 15/00

[52] U.S. Cl. ..... 8/115.6; 252/8.84

[58] Field of Search ..... 8/115.51, 115.64, 8/115.6; 252/8.81, 8.84; 510/347, 360, 466; 427/387; 106/287.14, 287.15

[56] References Cited

U.S. PATENT DOCUMENTS

| | | | |
|---|---|---|---|
| 3,968,042 | 7/1976 | Erickson | 510/138 |
| 4,105,569 | 8/1978 | Crossfield | 428/391 |
| 4,561,987 | 12/1985 | Yamamoto et al. | 252/8.84 |
| 5,036,123 | 7/1991 | Ozaki et al. | 524/267 |
| 5,470,563 | 11/1995 | Tanaka et al. | 424/448 |
| 5,500,254 | 3/1996 | Quincy, III et al. | 427/387 |
| 5,755,984 | 5/1998 | Yamamoto | 252/8.84 |
| 5,772,910 | 6/1998 | Yamamoto et al. | 252/8.84 |

FOREIGN PATENT DOCUMENTS

| | | |
|---|---|---|
| 839947 | 5/1998 | European Pat. Off. . |
| 49-027695 | 3/1974 | Japan . |
| 49-030621 | 3/1974 | Japan . |
| 59-144682 | 8/1984 | Japan . |
| 1499385 | 2/1978 | United Kingdom . |

OTHER PUBLICATIONS

Caplus Abstract of JP 09–215706 (Aug. 1997).

Caplus Abstract of JP 10–131055 (May 1998).

*Primary Examiner*—Caroline D. Liott

*Attorney, Agent, or Firm*—Majestic, Parsons, Siebert & Hsue P.C.

[57] ABSTRACT

An agent containing a polyether compound, a straight-chain polyether modified polyorganosiloxane of a specified kind and an ionic surfactant at specified ratios are applied at a specified rate to synthetic fibers subjected to a heat treatment such as false twisting.

7 Claims, No Drawings

AGENTS FOR AND METHODS OF PROCESSING SYNTHETIC FIBERS

This is a continuation-in-part of application Ser. No. 09/238,208 filed Jan. 27, 1999, now abandoned.

BACKGROUND OF THE INVENTION

This invention relates to agents for and methods of processing synthetic fibers.

During the course of production and processing of synthetic fibers, an agent containing a lubricant and an antistatic agent is usually applied to them in order to provide them with lubricity and antistatic characteristic. When the synthetic fibers are subjected to a heat treatment or, for example, to a false twisting process, however, it is important to prevent the contamination of heaters due to the thermal degradation of such agent during the heat treatment and to thereby prevent the generation of fuzz and occurrence of yarn breakage and to obtain false-twisted yarns of a high quality. This invention relates to agents and methods with which such contamination of heaters can be effectively prevented.

As an agent for preventing such contamination of heaters, it has been known to use a mixture of a polyether compound, a polyorganosiloxane compound and an ionic surfactant. Examples of polyorganosiloxane compound which may be mixed in such a prior art agent include (1) polydimethyl siloxane and fluoroalkyl modified polydimethyl polysiloxane with viscosity at 25° C. greater than $30\times10^{-6}$ $m^2/s$ and surface tension at 25° C. less than 28 dyne/cm (See Japanese Patent Publication Tokkai 54-46923), (2) polydimethyl siloxane with viscosity at 30° C. greater than $15\times10^{-6}$ $m^2/s$ (See Japanese Patent Publication Tokkai 48-53093), (3) phenyl polysiloxane with viscosity at 30° C. in the range of $10\times10^{-6}$–$80\times10^{-6}$ $m^2/s$ (Japanese Patent Publication Tokko 47-50657), (4) polyether modified polyorganosiloxane (U.S. Pat. Nos. 4,561,987 and 5,061,384), (5) linear polyorganosiloxane with 4–12 siloxane units (U.S. Pat. No. 5,772,910), and (6) ring-like polyorganosiloxane with 4–14 siloxane units (U.S. Pat. No. 5,755,984). With these prior art agents, however, contamination of heaters during a heat treatment cannot be prevented sufficiently. In the case of a false twisting process using short heaters of a recently developed kind for heat treatments at temperatures over 300° C., in particular, the contamination of heaters could not be prevented satisfactorily. As explained above, if the contamination of heaters cannot be prevented to a satisfactory degree in the heat treatment process, fuzz and yarn breakage will take place and it is not possible to produce yarns with a high quality.

SUMMARY OF THE INVENTION

The problem to be solved by this invention is that prior art agents could not satisfactorily prevent the contamination of heaters for heat treatment and in particular for an false twisting process using short heaters operating at temperatures above 300° C.

This invention is based on the present inventors' discovery that the problem stated above can be obviated if use is made of an agent comprising a polyether compound, a straight-chain polyether modified polyorganosiloxane of a specified kind and an ionic surfactant, containing the straight-chain polyether modified polyorganosiloxane and the ionic surfactant at specified ratios and that such an agent should be applied at a specified ratio to synthetic fibers which are subjected to a heat treatment.

DETAILED DESCRIPTION OF THE INVENTION

This invention relates to fiber processing agents comprising a polyether compound, a straight-chain polyether modified polyorganosiloxane shown by Formula (1) given below at a ratio of 0.1–12 weight % and an ionic surfactant at a ratio of 0.1–12 weight %:

Formula (1)

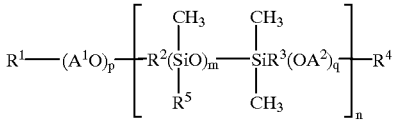

where $R^1$ and $R^4$ are each either a residual group obtained by removing active hydrogen from a monohydric compound containing active hydrogen and having 1–40 carbon atoms or hydroxyl group; $R^2$ and $R^3$ are each alkylene group with 3 or 4 carbon atoms, $R^5$ is alkyl group with 1–4 carbon atoms, fluoroalkyl group with 1–4 carbon atoms or phenyl group, $A^1$ and $A^2$ are each alkylene group with 2–4 carbon atoms, p and q are each an integer 2–200, m is an integer 3–200 and n is an integer 1–30.

The invention also relates to a method of applying such an agent at a rate of 0.1–3 weight % of the synthetic fibers to be subjected to a heat treatment.

Examples of straight-chain polyether modified polyorganosiloxane shown by Formula (1) include (1) those, for which n=1, of a structure having one linear polyether unit connected as a straight chain at each end of one linear polysiloxane unit through a connecting group such that both ends are a linear polyether unit, and (2) those, for which n=2–30, of a structure having two or more linear polysiloxane units and two or more linear polyether units connected as a straight chain through a connecting group such that both ends are a linear polyether unit.

The end groups $R^1$ and $R^4$ of linear polyether units of Formula (1) may or may not be different from each other, each being either a residual group obtained by removing active hydrogen from a monohydric compound containing active hydrogen and having 1–40 carbon atoms or hydroxyl group. Examples of such monohydric compound containing active hydrogen and having 1–40 carbon atoms include (1) aliphatic saturated alcohols with 1–40 carbon atoms such as methanol, octanol, stearyl alcohol, ceryl alcohol, isobutanol, 2-ethyl hexanol, isohexadecyl alcohol, isotetracosanyl alcohol, 2-propanol and 12-eicosanyl alcohol, (2) aliphatic unsaturated alcohols with 2–40 carbon atoms such as vinyl alcohol, propenyl alcohol, oleyl alcohol, eicosenyl alcohol, 2-methyl-2-propylene-1-ol and 15-hexadecene-2-ol, (3) phenol, (4) octyl phenols substituted by alkyl group with 1–34 carbon atoms such as propyl phenol, octyl phenol and tridecyl phenol, (5) aliphatic saturated thiols with 1–40 carbon atoms such as octane thiol, octadecan thiol, 2-ethylhexane thiol and isododecan thiol, (6) aliphatic saturated carboxylic acids with 1–40 carbon atoms such as acetic acid, lauric acid and behenic acid, (7) aliphatic unsaturated carboxylic acids with 2–40 carbon atoms such as oleic acid, erucic acid and linoleic acid, (8) aliphatic alkylamines with 2–40 carbon atoms such as butylamine and dioleylamine, and (9) aliphatic alkanolamines with 4–40 carbon atoms such as dibutyl ethanolamine and diisostearyl propylamine. Of these, monohydric compounds containing active hydrogen and having alkoxy group with 1–10 carbon atoms formed from aliphatic saturated alcohol with 1–10 carbon atoms or alkenoxy group with 2–10 carbon atoms formed from aliphatic unsaturated alcohol with 2–10 carbon atoms are preferable.

In Formula (1), $A^1$ and $A^2$ are alkylene groups with 2–4 carbon atoms. Examples of such alkylene group include ethylene group, propylene group, 1,2-butylene group and 1,4-butylene group. These alkylene groups may appear singly or in a mixed form but those with only ethylene groups and a mixture of ethylene and propylene groups are preferred. When ethylene and propylene groups are mixed, the manner of combination between oxyethylene units and oxypropylene units or combination between ethoxy units and propoxy units that are formed may be block combination or random combination.

The number p of the alkoxy units and the number q of the oxyalkylene units of Formula (1) are within the range of 2–200 but this range should preferably be 20–150 and more preferably 30–100.

In Formula (1), $R^5$ inside the divalent siloxane unit is alkyl group with 1–4 carbon atoms, fluoroalkyl group with 1–4 carbon atoms or phenyl group. Examples of such alkyl group with 1–4 carbon atoms include methyl group, ethyl group, propyl group and butyl group. Examples of fluoroalkyl group include not only partial fluorine substituted alkyl groups such as γ-trifluoropropyl group and β,γ-pentafluoropropyl group but also total fluorine substituted alkyl groups such as heptafluoropropyl group and pentafluoroethyl group, but methyl group is preferred.

The number m of the divalent siloxane units in Formula (1) is an integer between 3–200 but this range is preferably 5–20 and more preferably 6–14.

The connecting groups $R^2$ and $R^3$ between linear polyether units and linear polysiloxane units of Formula (1) are alkylene groups with 3 or 4 carbon atoms. Such alkylene groups serving as a connecting group, having 3 or 4 carbons atoms, contain a carbon atom directly connected to a silicon atom in a linear polysiloxane unit. Examples of such alkylene group with 3 or 4 carbon atoms include trimethylene group, tetramethylene group, isopropylene group and isobutylene group, of which, however, trimethylene group, tetramethylene group and isobutylene group are preferred.

The number n of the units formed with linear polysiloxane units and linear polyether units is an integer between 1–30 but this range is preferably 1–9.

This invention is not limited by the method of synthesizing the straight chain polyether modified polyorganosiloxane to be used therein. Examples of the method for the synthesis include (1) the method of reacting corresponding α,ω-dihydrogen poly(partially substituted)dimethyl siloxane (1 mole) with one-end (meth)allyl polyalkoxylate (2 moles) with heating in the presence of chloroplatinic acid as catalyst, (2) the method of reacting corresponding α,ω-dihydrogen poly(partially substituted)dimethyl siloxane (more than 2 moles) with both-end (meth)allyl polyalkoxylate (more than 2 moles) with heating in the presence of chloroplatinic acid as catalyst, and (3) the method of reacting corresponding α,ω-dihydrogen poly(partially substituted)dimethyl siloxane (more than 2 moles) with both-end (meth)allyl polyalkoxylate (more than 2 moles) with heating in the presence of chloroplatinic acid as catalyst and causing the dimethylsilyl group of the compound thus obtained, having linear polysiloxane units at the ends, to react with one-end (meth)allyl polyalkoxylate.

Examples of the ionic surfactant which may be used according to this invention include known kinds of anionic surfactants, cationic surfactants and ampholitic surfactants. Quaternary onium salt shown by Formula (2) given below is an preferred example of the ionic surfactant:

Formula (2)

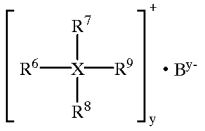

where X is N or P, $R^6$, $R^7$, $R^8$ and $R^9$ are each alkyl group with 1–25 carbon atoms, alkenyl group with 2–25 carbon atoms or hydroxyalkyl group with 1–6 carbon atoms, $B^{y-}$ is anion group of valence y obtained by removing hydrogen ion from a compound selected from acidic phosphoric acid esters with 1–30 carbon atoms, acidic sulfuric acid esters with 1–30 carbons atoms, acidic sulfonic acid esters with 1–30 carbon atoms and carboxylic acids with 1–30 carbon atoms, and y is an integer 1–3.

Examples of quaternary onium salt shown by Formula (2) include (1) those, for which X is N, comprising quaternary ammonium cation group and anion group obtained by removing hydrogen ions either partially or totally from the aforementioned compound with valence 1–3, and (2) those, for which X is P, comprising quaternary phosphonium cation group and anion group obtained by removing hydrogen ions either partially or totally from the aforementioned compound with valence 1–3.

First, quaternary ammonium salts according to this invention will be explained more in detail. Examples of quaternary ammonium cation group forming quaternary ammonium salts include (1) those wherein $R^6$–$R^9$ (hereinafter referred to as the organic groups of Formula (2)) are all alkyl group with 1–25 carbon atoms, (2) those wherein the organic groups of Formula (2) are all alkenyl group with 2–25 carbon atoms, (3) those wherein the organic groups of Formula (2) are all hydroxyalkyl group with 1–6 carbon atoms, (4) those wherein some of the organic groups of Formula (2) are alkyl group with 1–25 carbon atoms and the rest are alkenyl group with 2–25 carbon atoms, (5) those wherein some of the organic groups of Formula (2) are alkyl group with 1–25 carbon atoms and the rest are hydroxyalkyl group with 1–6 carbon atoms, (6) those wherein some of the organic groups of Formula (2) are alkenyl group with 2–25 carbon atoms and the rest are hydroxyalkyl group with 1–6 carbon atoms, and (7) those wherein some of the organic groups of Formula (2) are alkyl group with 1–25 carbon atoms, some of the others are alkenyl group with 2–25 carbon atoms and the rest are hydroxyalkyl group with 1–6 carbon atoms.

Examples of preferred quaternary ammonium cation group wherein the organic groups of Formula (2) are all alkyl group with 1–25 carbon atoms include tetramethyl ammonium, triethylmethyl ammonium, tripropylethyl ammonium, tributylmethyl ammonium, tetrabutyl ammonium, triisooctylethyl ammonium, trimethyloctyl ammonium, dilauryl dimethyl ammonium and trimethylstearyl ammonium. Examples of preferred quaternary ammonium cation group wherein some of the organic groups of Formula (2) are alkyl group with 1–25 carbon atoms and the rest are alkenyl group with 2–25 carbon atoms include dibutenyl diethyl ammonium, dimethyl dioleyl ammonium, trimethyloleyl ammonium and triethyl eicosenyl ammonium. Examples of preferred quaternary ammonium cation group wherein some of the organic groups of Formula (2) are alkyl group with 1–25 carbon atoms and the rest are hydroxyalkyl group with 1–6 carbon atoms include tributylhydroxyethyl ammonium, di(hydroxyethyl) dipropyl ammonium, tri(hydroxyethyl) octyl ammonium and tri (hydroxypropyl) methyl ammonium. Particularly preferable are those wherein the organic groups of Formula (2) are all alkyl group with 1–12 carbon atoms, those wherein some of the organic groups of Formula (2) are alkenyl group with 16–22 carbon atoms and the rest are alkyl group with 1–12 carbon atoms, and those wherein some of the organic groups of Formula (2) are hydroxyalkyl group with 2–4 carbon atoms and the rest are alkyl group with 1–12 carbon atoms, such as tributylmethyl ammonium, tetrabutyl ammonium, trimethyloleyl ammonium and di(hydroxyethyl) methyloctyl ammonium.

The anion groups forming the aforementioned quaternary ammonium salts are those obtained by partially or totally removing the hydrogen ions from the aforementioned compound with valence 1–3. Examples of such compound with valence 1–3 include (1) acidic phosphoric acid esters with 1–30 carbon atoms such as methyl phosphate, diethyl phosphate, dioctyl phosphate, methyloleyl phosphate and nonylphenyl oxyethoxyethyl·methyl phosphate, (2) acidic sulfuric acid esters with 1–30 carbon atoms such as methyl sulfate, ethyl sulfate, lauryl sulfate and octylphenyloxypolyethoxy (the repetition number of ethoxy units being 3, or n=3) ethyl sulfate, (3) acidic sulfonic acid esters with 1–30 carbon atoms such as butyl sulfonate, lauryl sulfonate, stearyl sulfonate, dodecylphenyl sulfonate, oleylphenyl sulfonate, naphthyl sulfonate and diisopropylnaphthyl sulfonate, and (4) carboxylic acids with 1–30 carbons atoms including aliphatic monocarboxylic acids such, as acetic acid, caproic acid, lauric acid, 2-ethylhexanoic acid, isostearic acid, oleic acid and erucic acid, aliphatic dicarboxylic acids such as malonic acid, adipic acid, sebacic acid and pentadecenyl succinic acid, aromatic carboxylic acids with 1–30 carbon atoms such as benzoic acid, phthalic acid and trimellitic acid, aliphatic hydroxy carboxylic acids such as lactic acid, ricinoleic acid and 12-hydroxystearic acid, and sulphur-containing aliphatic carboxylic acids with 1–30 carbon atoms such as thio-dipropionic acid. Preferable among these are aliphatic phosphates with 1–26 carbon atoms, aliphatic sulfonates with 1–26 carbon atoms and aliphatic carboxylic acids with 1–26 carbon atoms, and still more preferable among these are aliphatic sulfonates with 8–24 carbon atoms and aliphatic carboxylic acids with 8–24 carbon atoms such as lauryl sulfonate, oleyl sulfonate, isostearic acid, oleic acid and pentadecenyl succinic acid.

This invention is not limited particularly by the method by which such quaternary ammonium salts to be used in this invention should be synthesized. Examples of method for the synthesis include (1) method of reacting corresponding tertiary amine with trialkyl phosphate, (2) method of reacting corresponding tertiary amine with dialkyl sulfate, (3) method of reacting corresponding tertiary amine with ethylene oxide in the presence of water to obtain quaternary ammonium hydroxide and then reacting it with acidic sulfonic acid esters, and (4) method of reacting corresponding tertiary amine with alkyl halide to obtain quaternary ammonium halide and then reacting it with metallic salt of carboxylic acid.

Next, quaternary phosphonium salts according to this invention will be explained. Examples of quaternary phosphonium cation group forming quaternary phosphonium salts include, similarly to the description given above regarding quaternary ammonium cation groups, (1) those wherein the organic groups of Formula (2) are all alkyl group with 1–25 carbon atoms, (2) those wherein the organic groups of Formula (2) are all alkenyl group with 2–25 carbon atoms, (3) those wherein the organic groups of Formula (2) are all hydroxyalkyl group with 1–6 carbon atoms, (4) those wherein some of the organic groups of Formula (2) are alkyl group with 1–25 carbon atoms and the rest are alkenyl group with 2–25 carbon atoms, (5) those wherein some of the organic groups of Formula (2) are alkyl group with 1–25 carbon atoms and the rest are hydroxyalkyl group with 1–6 carbon atoms, (6) those wherein some of the organic groups of Formula (2) are alkenyl group with 2–25 carbon atoms and the rest are hydroxyalkyl group with 1–6 carbon atoms, and (7) those wherein some of the organic groups of Formula (2) are alkyl group with 1–25 carbon atoms, some of the others are alkenyl group with 2–25 carbon atoms and the rest are hydroxyalkyl group with 1–6 carbon atoms.

Examples of preferred quaternary phosphonium cation group wherein the organic groups of Formula (2) are all alkyl group with 1–25 carbon atoms include tetramethyl phosphonium, tributylmethyl phosphonium, tetrabutyl phosphonium, methyl trioctyl phosphonium and lauryl trimethyl phosphonium. Examples of preferred quaternary phosphonium cation group wherein some of the organic groups of Formula (2) are alkyl group with 1–25 carbon atoms and the rest are alkenyl group with 2–25 carbon atoms include trimethyloleyl phosphonium and oleyl tripropenyl phosphonium. Examples of preferred quaternary phosphonium cation group wherein some of the organic groups of Formula (2) are alkyl group with 1–25 carbon atoms and the rest are hydroxyalkyl group with 1–6 carbon atoms include tributyl (2-hydroxyethyl) phosphonium and trioctyl (4-hydroxybutenyl) phosphonium. Particularly preferable are those wherein the organic groups of Formula (2) are all alkyl group with 1–4 carbon atoms, such as tributylmethyl phosphonium and tetrabutyl phosphonium.

The anion groups forming these quaternary phosphonium salts are the same as those described above for forming quaternary ammonium salts.

This invention is not limited particularly by the method by which such quaternary phosphonium salts to be used in this invention should be synthesized. Examples of method for the synthesis include (1) method of mixing metallic or ammonium salt of the corresponding organic acid with quaternary phosphonium salt inside a solvent and washing with water and separating the inorganic salt obtained as by-product, and (2) method of using an organic solvent such as methanol, isopropanol or acetone to carry out extraction.

Polyether compounds of known kinds such as disclosed in Japanese Patent Publication Tokkai 56-31077 and U.S. Pat. No. 4,561,987 may be used for the purpose of this invention. Preferred examples of such polyether compound include polyether (poly)ols such as polyether monool, polyether diol and polyether triol. Such preferred examples of polyether compound include (1) those obtainable by block and/or random addition of alkylene oxide with 2–4 carbon atoms such as ethylene oxide, propylene oxide, 1,2-butylene oxide and tetrahydofuran to monohydric alcohol such as methyl alcohol, ethyl alcohol, isopropyl alcohol, butyl alcohol, isoamyl alcohol, n-octyl alcohol, 2-ethylhexyl alcohol, dodecyl alcohol, isotridecyl alcohol, isocetyl alcohol, stearyl alcohol, isostearyl alcohol and oleyl alcohol; (2) those obtainable by block and/or random addition of alkylene oxide with 2–4 carbon atoms as above to dihydric alcohol such as ethylene glycol, propylene glycol, neopentyl glycol and hexylene glycol; and (3) those obtainable by block and/or random addition of alkylene oxide with 2–4 carbon atoms as above to polyhydric (trihydric to hexahydric) alcohol such as glycerol, trimethyl propane, pentaerythritol, sorbitan and sorbitol. Particularly preferable are those with average molecular weight of 700–20000. "Polyether compound" within the context of this invention includes mixtures of polyether compounds with different molecular weights. When such a mixture is used, it is preferable to use a mixture with a polyether compound with average molecular weight of 1000–3000 and another with average molecular weight of 5000–15000.

As described above, the agents according to this invention are characterized as comprising a polyether compound, straight-chain polyether modified polyorganosiloxane and an ionic surfactant. Straight-chain polyether modified polyorganosiloxane is to be contained at a ratio of 0.1–12 weight %, and the ionic surfactant is also to be contained at a ratio of 0.1–12 weight %, but it is preferred that straight-chain polyether modified polyorganosiloxane be contained at a ratio of 0.3–5 weight %, and quaternary onium salt of the kind described above as the ionic surfactant be contained at a ratio of 0.3–5 weight %.

In addition to a polyether compound, straight-chain polyether modified polyorganosiloxane and an ionic surfactant, it is preferred that an ester compound of a specified kind and/or an ether ester compound be further contained at a specified ratio. There is no particular limitation as to the kind of ester compound as long as the total number of carbon atoms is 10–50. Examples of such ester compound include (1) aliphatic monoesters of aliphatic alcohol and aliphatic carboxylic acid such as ethyl laurate, octyl laurate, isodecylstearate and oleyl docosenoate, and (2) aliphatic polyhydric esters of aliphatic alcohol and aliphatic carboxylic acid such as 1,4-butanediol dioctanate, dioleyl adipate, trimethylolethane diisostearate and glycerine trilaurate, but aliphatic monoesters with total number of carbon atoms 15–30 are preferable.

There is no particular limitation as to the ether ester compound as long as the total number of carbon atoms is 10–50. Many examples obtainable by reacting alkylene oxide with 2–4 carbon atoms with an ester compound as described above may be considered, but those with the total number of carbon atoms 20–40 obtainable by reacting monoester of aliphatic alcohol and aliphatic carboxylic acid with 1–10 moles of ethylene oxide are preferred.

When such ester compound and/or ether ester compound is added, the ratio is about 1–30 weight % of the agent. Preferred ratios of mixing are 0.3–5 weight % for straight-chain polyether modified polyorganosiloxane, 0.3–5 weight % for quaternary onium salt as ionic surfactant, and 3–25 weight % for ester compound and/or ether ester compound, the remainder being polyether compound.

According to the method of this invention, an agent as described above is applied to synthetic fibers to be subjected to a heat treatment at a ratio of 0.1–3 weight % and preferably 0.2–1 weight %. Normally, the agent is applied to synthetic fiber filament yarns immediately after the spinning process, and these yarns are thereafter subjected to a heat treatment. With an agent of this invention thus applied, synthetic fibers acquire lubricity and hence the contamination of heaters used in the heat treatment can be effectively prevented. Examples of heat treatment process include drawing process, twisting process, crimp-setting process and false twisting process, but the present invention is effective particularly when the synthetic fibers are subjected to a false twisting process. Examples of false twisting apparatus include (1) apparatus of a contact heater type provided with a heater of temperature 150–230° C. and length 150–250 cm such that synthetic fiber filament yarns are passed in contact with and over a heater plate, and (2) apparatus of a short heater type provided with a heater with temperature 300–600° C. and length 20–150 cm such that synthetic fiber filament yarns travels over the heater plate without touching it. The agents and methods of this invention are particularly effective, however, when used in a false twisting process by means of an apparatus provided with a short heater with temperature 350–550° C. and length 20–140 cm such that synthetic fiber filament yarns travel in contact with yarn path regulating device set inside the heater.

This invention imposes no particular limitation on the method of applying an agent of this invention on synthetic fibers. Examples of method of application include conventional methods such as roller oiling method, guide oiling method by means of a measuring pump, lubrication by soaking and spray lubrication method, but roller oiling method and guide oiling method with a measuring pump are preferred.

When an agent of this invention is applied to synthetic fibers, it may be done in the form of an aqueous emulsion, as a solution in an organic solvent or by itself, but it is preferred to use it as an aqueous emulsion. In such a situation, an emulsifier may be used appropriately, and it is preferable to prepare the aqueous emulsion so as to contain the agent at a ratio of 5–30 weight %. When the agent is applied to synthetic fibers, other agents such as an antioxidant, an antiseptic and an anti-rusting agent may be applied at the same time, depending on the purpose, but the amount of their use should be as small as possible.

Examples of synthetic fibers to which the agents and methods of this invention can be applied include (1) polyester fibers having ethylene terephthalate as its main structural unit, (2) polyamide fibers such as nylon 6 and nylon 66, (3) polyacrylic fibers such as polyacrylonitrile and modacrylic fibers, and (4) polyolefins such as polyethylene and polypropylene. This invention is particularly effective, however, when applied to partially drawn polyester yarns, partially drawn polyamide yarns or directly spun drawn polyester yarns.

The invention is described next by way of the following 52 embodiments. Details of the polyether compound, straight-chain polyether modified polyorganosiloxane, ionic surfactant, ester compound and ether ester compound which are used in these embodiments will be described further below.

(1) The agent contains polyether compound (P-1) by 96 weight %, straight-chain polyether modified polyorganosiloxane (MS-1) by 2 weight % and ionic surfactant (QS-1) by 2 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(2) The agent in Embodiment (1) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(3) The agent contains polyether compound (P-1) by 94 weight %, straight-chain polyether modified polyorganosiloxane (MS-1) by 2 weight % and ionic surfactant (QS-1) by 4 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(4) The agent in Embodiment (3) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(5) The agent contains polyether compound (P-2) by 82 weight %, straight-chain polyether modified polyorganosiloxane (MS-2) by 3 weight %, ionic surfactant (QS-2) by 1 weight %, ester compound (ES-1) by 4 weight % and ether ester compound (EE-1) by 10 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(6) The agent in Embodiment (5) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(7) The agent contains polyether compound (P-1) by 95 weight %, straight-chain polyether modified polyorganosiloxane (PS-1) by 3 weight % and ionic surfactant (QS-3) by 2 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(8) The agent in Embodiment (7) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(9) The agent contains polyether compound (P-1) by 90 weight %, straight-chain polyether modified polyorganosiloxane (S-2) by 4 weight %, ionic surfactant (QS-4) by 1 weight %, and ether ester compound (EE-2) by 5 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(10) The agent in Embodiment (9) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(11) The agent contains polyether compound (P-1) by 93 weight %, straight-chain polyether modified polyorganosiloxane (PS-2) by 4 weight %, and ionic surfactant (QS-4) by 3 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(12) The agent in Embodiment (11) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(13) The agent contains polyether compound (P-1) by 96 weight %, straight-chain polyether modified polyorganosiloxane (PS-3) by 2 weight %, and ionic surfactant (QS-5) by 2 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(14) The agent in Embodiment (13) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(15) The agent contains polyether compound (P-1) by 93 weight %, straight-chain polyether modified polyorganosiloxane (PS-4) by 5 weight %, and ionic surfactant (FN-1) by 2 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(16) The agent in Embodiment (15) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(17) The agent contains polyether compound (P-1) by 93 weight %, straight-chain polyether modified polyorganosiloxane (PS-5) by 5 weight %, and ionic surfactant (PA-1) by 2 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(18) The agent in Embodiment (17) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(19) The agent contains polyether compound (P-2) by 98.5 weight %, straight-chain polyether modified polyorganosiloxane (S-2) by 0.5 weight %, and ionic surfactant (QS-4) by 1 weight %. An aqueous emulsion is obtained with this agent and after it is applied to partially drawn polyester yarns at a ratio of 0.8 weight % as the agent, the yarns are subjected to a false twisting process by means of a false twisting apparatus of a contact heater type with heater temperature 210° C.

(20) The agent in Embodiment (19) is made into an aqueous emulsion and after it is applied to partially drawn polyester yarns at a ratio of 0.8 weight % as the agent, the yarns are subjected to a false twisting process by means of a false twisting apparatus with a short heater at temperature 510° C.

(21) The agent contains polyether compound (P-1) by 93 weight %, straight-chain polyether modified polyorganosiloxane (TS-1) by 5 weight %, and ionic surfactant (QS-1) by 2 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(22) The agent in Embodiment (21) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(23) The agent contains polyether compound (P-2) by 93 weight %, straight-chain polyether modified polyorganosiloxane (TS-2) by 2 weight %, and ionic surfactant (QS-2) by 5 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(24) The agent in Embodiment (23) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(25) The agent contains polyether compound (P-2) by 96 weight %, straight-chain polyether modified polyorganosiloxane (TS-3) by 2 weight %, and ionic surfactant (QS-3) by 2 weight %. An aqueous emulsion is obtained with this agent and after it is applied to partially drawn polyester yarns at a ratio of 0.4 weight % as the agent, the yarns are subjected to a false twisting process by means of a false twisting apparatus of a contact heater type with heater temperature 210° C.

(26) The agent in Embodiment (25) is made into an aqueous emulsion and after it is applied to partially drawn polyester yarns at a ratio of 0.4 weight % as the agent, the yarns are subjected to a false twisting process by means of a false twisting apparatus with a short heater at temperature 510° C.

(27) The agent contains polyether compound (P-1) by 90 weight %, straight-chain polyether modified polyorganosiloxane (MS-3) by 1 weight %, ionic surfactant (QS-4) by 7 weight % and ester compound (ES-1) by 2 weight %. An aqueous emulsion is obtained with this agent and after it is applied to partially drawn polyester yarns at a ratio of 0.3 weight % as the agent, the yarns are subjected to a false twisting process by means of a false twisting apparatus of a contact heater type with heater temperature 210° C.

(28) The agent in Embodiment (27) is made into an aqueous emulsion and after it is applied to partially drawn polyester yarns at a ratio of 0.3 weight % as the agent, the yarns are subjected to a false twisting process by means of a false twisting apparatus with a short heater at temperature 510° C.

(29) The agent contains polyether compound (P-1) by 89 weight %, straight-chain polyether modified polyorganosiloxane (MS-4) by 1 weight %, and ionic surfactant (QS-5) by 10 weight %. An aqueous emulsion is obtained with this agent and after it is applied to partially drawn polyester yarns at a ratio of 0.3 weight % as the agent, the yarns are subjected to a false twisting process by means of a false twisting apparatus of a contact heater type with heater temperature 210° C.

(30) The agent in Embodiment (29) is made into an aqueous emulsion and after it is applied to partially drawn polyester yarns at a ratio of 0.3 weight % as the agent, the yarns are subjected to a false twisting process by means of a false twisting apparatus with a short heater at temperature 510° C.

(31) The agent contains polyether compound (P-1) by 91 weight %, straight-chain polyether modified polyorganosiloxane (PS-6) by 6 weight %, and ionic surfactant (QS-1) by 3 weight %. An aqueous emulsion is obtained with this agent and after it is applied to partially drawn polyester yarns at a ratio of 0.3 weight % as the agent, the yarns are subjected to a false twisting process by means of a false twisting apparatus of a contact heater type with heater temperature 210° C.

(32) The agent in Embodiment (31) is made into an aqueous emulsion and after it is applied to partially drawn polyester yarns at a ratio of 0.3 weight % as the agent, the yarns are subjected to a false twisting process by means of a false twisting apparatus with a short heater at temperature 510° C.

(33) The agent contains polyether compound (P-1) by 88 weight %, straight-chain polyether modified polyorganosiloxane (PS-7) by 9 weight %, and ionic surfactant (FN-1) by 3 weight %. An aqueous emulsion is obtained with this agent and after it is applied to partially drawn polyester yarns at a ratio of 0.3 weight % as the agent, the yarns are subjected to a false twisting process by means of a false twisting apparatus of a contact heater type with heater temperature 210° C.

(34) The agent in Embodiment (33) is made into an aqueous emulsion and after it is applied to partially drawn polyester yarns at a ratio of 0.3 weight % as the agent, the yarns are subjected to a false twisting process by means of a false twisting apparatus with a short heater at temperature 510° C.

(35) The agent in Embodiment (5) is made into an aqueous emulsion and after it is applied to partially drawn nylon filament yarns at a ratio of 0.50 weight % as the agent, the yarns are subjected to a false twisting process by means of a false twisting apparatus of a contact heater type with heater temperature 210° C.

(36) The agent in Embodiment (5) is made into an aqueous emulsion and after it is applied to partially drawn nylon filament yarns at a ratio of 0.50 weight % as the agent, the yarns are subjected to a false twisting process by means of a false twisting apparatus with a short heater at temperature 460° C.

(37) The agent in Embodiment (7) is made into an aqueous emulsion and after it is applied to partially drawn nylon filament yarns at a ratio of 0.55 weight % as the agent, the yarns are subjected to a false twisting process by means of a false twisting apparatus of a contact heater type with heater temperature 210° C.

(38) The agent in Embodiment (7) is made into an aqueous emulsion and after it is applied to partially drawn nylon filament yarns at a ratio of 0.55 weight % as the agent, the yarns are subjected to a false twisting process by means of a false twisting apparatus with a short heater at temperature 460° C.

(39) The agent in Embodiment (9) is made into an aqueous emulsion and after it is applied to partially drawn nylon filament yarns at a ratio of 0.45 weight % as the agent, the yarns are subjected to a false twisting process by means of a false twisting apparatus of a contact heater type with heater temperature 210° C.

(40) The agent in Embodiment (9) is made into an aqueous emulsion and after it is applied to partially drawn nylon filament yarns at a ratio of 0.45 weight % as the agents the yarns are subjected to a false twisting process by means of a false twisting apparatus with a short heater at temperature 460° C.

(41) The agent in Embodiment (19) is made into an aqueous emulsion and after it is applied to partially drawn nylon filament yarns at a ratio of 0.65 weight % as the agent, the yarns are subjected to a false twisting process by means of a false twisting apparatus of a contact heater type with heater temperature 210° C.

(42) The agent in Embodiment (19) is made into an aqueous emulsion and after it is applied to partially drawn nylon filament yarns at a ratio of 0.65 weight % as the agent, the yarns are subjected to a false twisting process by means of a false twisting apparatus with a short heater at temperature 460° C.

(43) The agent in Embodiment (21) is made into an aqueous emulsion and after it is applied to partially drawn nylon filament yarns at a ratio of 0.55 weight % as the agent, the yarns are subjected to a false twisting process by means of a false twisting apparatus of a contact heater type with heater temperature 210° C.

(44) The agent in Embodiment (21) is made into an aqueous emulsion and after it is applied to partially drawn nylon filament yarns at a ratio of 0.55 weight % as the agent, the yarns are subjected to a false twisting process by means of a false twisting apparatus with a short heater at temperature 460° C.

(45) The agent in Embodiment (5) is made into an aqueous emulsion and after it is applied to directly spun polyester drawn yarns at a ratio of 0.35 weight % as the agent, the yarns are subjected to a false twisting process by means of a false twisting apparatus of a contact heater type with heater temperature 210° C.

(46) The agent in Embodiment (5) is made into an aqueous emulsion and after it is applied to directly spun polyester drawn yarns at a ratio of 0.35 weight % as the agent, the yarns are subjected to a false twisting process by means of a false twisting apparatus with a short heater at temperature 510° C.

(47) The agent in Embodiment (9) is made into an aqueous emulsion and after it is applied to directly spun polyester drawn yarns at a ratio of 0.35 weight % as the agent, the yarns are subjected to a false twisting process by means of a false twisting apparatus of a contact heater type with heater temperature 210° C.

(48) The agent in Embodiment (9) is made into an aqueous emulsion and after it is applied to directly spun polyester drawn yarns at a ratio of 0.35 weight % as the agent, the yarns are subjected to a false twisting process by means of a false twisting apparatus with a short heater at temperature 510° C.

(49) The agent in Embodiment (15) is made into an aqueous emulsion and after it is applied to directly spun polyester drawn yarns at a ratio of 0.35 weight % as the agent, the yarns are subjected to a false twisting process by means of a false twisting apparatus of a contact heater type with heater temperature 210° C.

(50) The agent in Embodiment (15) is made into an aqueous emulsion and after it is applied to directly spun polyester drawn yarns at a ratio of 0.35 weight % as the agent, the yarns are subjected to a false twisting process by means of a false twisting apparatus with a short heater at temperature 510° C.

(51) The agent in Embodiment (23) is made into an aqueous emulsion and after it is applied to directly spun polyester drawn yarns at a ratio of 0.35 weight % as the agent, the yarns are subjected to a false twisting process by means of a false twisting apparatus of a contact heater type with heater temperature 210° C.

(52) The agent in Embodiment (23) is made into an aqueous emulsion and after it is applied to directly spun polyester drawn yarns at a ratio of 0.35 weight % as the agent, the yarns are subjected to a false twisting process by means of a false twisting apparatus with a short heater at temperature 510° C.

In what follows, the invention and its effects will be described with reference to test examples and comparison examples, but these test examples are not intended to limit the scope of this invention. In the following, "parts" shall mean "weight parts" and "%" shall mean "weight %".

EXAMPLES

Part 1 (Preparation of Agents)

Agent Test Example 2 was prepared by mixing 94 parts of polyether compound (P-1), 2 parts of straight-chain polyether modified polyorganosiloxane (MS-2) and 4 parts of ionic surfactant (QS-1). Other agents were similarly prepared. Some of these are shown in Tables 1 and 2.

In addition to the comparison examples shown in Table 2, the following comparison examples were additionally prepared:

Comparison Example 16a: This agent was prepared according to Table 4-1 in U.S. Pat. No. 5,470,563, consisting of cetyloxy polyethylene glycol ether (average molecular weight=8000), straight-chain polyether modified silicone (average molecular weight=6000) with block addition of oxyethylene units and oxypropylene units at molar ratio of 90/10, and sodium lauryl sulfate in the weight ratio of 22/56/22.

Comparison Example 16b: This agent was prepared similarly to Comparison Example 16a except that polyether compound (P-1) was used instead of cetyloxy polyethylene glycol ether and the ratio was according to the present invention, consisting of polyether compound (P-1), straight-chain polyether modified silicone (average molecular weight=6000) with oxyethylene units and oxypropylene units at molar ratio of 20/10, and sodium lauryl sulfate in the weight ratio of 90/5/5.

Comparison Example 16c: This agent was prepared according to U.S. Pat. No. 5,772,910 by using polyorganosiloxane described in its Table 1, consisting of polyether compound (P-5), linear polyorganosiloxane (A-1), ionic surfactant (PA-2) and nonylphenoxy polyethylene (7 mole) glycol ether in the weight ratio of 89.1/1.8/3/6.4, where polyether compound (P-5) is a mixture of butoxy polyalkylene glycol ether (average molecular weight=1500) with random addition of oxyethylene units and oxypropylene units at molar ratio of 70/30 and polyalkylene glycol ether (average molecular weight=7000) with random addition of oxyethylene units and oxypropylene units in the molar ratio of 20/80 in the weight ratio of 50/50, linear polyorganosiloxane (A-1) is polyorganosiloxane with 8 dimethyl siloxane units and 2 trimethyl silyl units and viscosity at 25° C. equal to $5\times10^{-6}$ $m^2/s$, and ionic surfactant (PA-2) is dibutylethanol amine salt of dodecyloxy polyethoxy (n=3) ethylphosphate.

Comparison Example 16d: This agent was prepared corresponding to U.S. Pat. No. 2,036,123 by using polyoxyalkylene siloxane A as described therein, consisting of dimethyl polysiloxane (10 cst) and polyoxyalkylene siloxane A at weight ratio of 100/1.

Comparison Example 16e: This agent was prepared corresponding to U.S. Pat. No. 3,968,042 by using pendant-type polyether modified polyorganosiloxane (cr-3) prepared according to said Patent (in column 4 at lines 42–55), consisting of pendant-type polyether modified polyorganosiloxane (cr-3) and distearyl dimethyl ammonium chloride at weight ratio of 70/30.

Comparison Example 16f: This agent was prepared by adding polyether compound (P-1) to the constituents of Comparison Example 16e, consisting of polyether compound (P-1), pendant-type polyether modified polyorganosiloxane (cr-3) and distearyl dimethyl ammonium chloride at weight ratio of 90/5/5.

TABLE 1

| | Polyether Compound | | Straight-chain Polyether Modified Polyorgano-siloxane | | Ionic Surfactant | | Others | |
|---|---|---|---|---|---|---|---|---|
| | Kind | Amount | Kind | Amount | Kind | Amount | Kind | Amount |
| Test Examples | | | | | | | | |
| 2 | P-1 | 94 | MS-2 | 2 | QS-1 | 4 | | |
| 3 | P-1 | 82 | MS-2 | 3 | QS-2 | 1 | ES-1 | 4 |
| | | | | | | | EE-1 | 10 |
| 4 | P-1 | 95 | PS-1 | 3 | QS-3 | 2 | | |
| 5 | P-1 | 90 | PS-2 | 4 | QS-4 | 1 | EE-2 | 5 |
| 6 | P-1 | 93 | PS-2 | 4 | QS-4 | 3 | | |
| 7 | P-1 | 96 | PS-3 | 2 | QS-5 | 2 | | |
| 10 | P-2 | 98.5 | PS-2 | 0.5 | QS-4 | 1 | | |
| 19 | P-4 | 86 | PS-1 | 2 | QS-6 | 2 | EE-1 | 10 |

TABLE 2

| | Polyether Compound | | Straight-chain Polyether Modified Polyorgano-siloxane | | Ionic Surfactant | | Others | |
|---|---|---|---|---|---|---|---|---|
| | Kind | Amount | Kind | Amount | Kind | Amount | Kind | Amount |
| Comparison Examples | | | | | | | | |
| 1 | P-1 | 95.95 | MS-2 | 0.05 | QS-1 | 4 | | |
| 2 | P-1 | 95.95 | PS-2 | 4 | QS-1 | 0.05 | | |
| 3 | P-1 | 81 | MS-2 | 15 | QS-1 | 4 | | |
| 4 | P-1 | 81 | PS-2 | 4 | QS-1 | 15 | | |
| 5 | P-1 | 93 | | | QS-1 | 2 | cr-1 | 5 |
| 6 | P-1 | 93 | | | QS-2 | 2 | cr-2 | 5 |
| 7 | P-1 | 90 | | | QS-3 | 5 | cr-3 | 5 |
| 8 | P-1 | 95 | | | QS-4 | 2 | cr-3 | 3 |

TABLE 2-continued

| | Polyether Compound | | Straight-chain Polyether Modified Polyorgano-siloxane | | Ionic Surfactant | | Others | |
|---|---|---|---|---|---|---|---|---|
| | Kind | Amount | Kind | Amount | Kind | Amount | Kind | Amount |
| 9 | P-1 | 92 | | | QS-5 | 3 | cr-4 | 5 |
| 10 | P-1 | 98 | | | QS-5 | 2 | | |
| 11 | P-2 | 94 | | | QS-1 | 2 | cr-1 | 4 |
| 12 | P-2 | 93 | | | QS-2 | 3 | cr-2 | 4 |
| 13 | P-2 | 92 | | | FN-1 | 5 | cr-3 | 3 |
| 14 | P-2 | 94 | | | PA-1 | 2 | cr-4 | 4 |
| 15 | | | PS-2 | 50 | QS-4 | 50 | | |
| 16 | P-3 | 95.95 | MS-3 | 0.05 | QS-1 | 4 | | |

In Tables 1 and 2:

Amount: Used amount in weight %

(P-1): Mixture of 70 parts of methoxy polyalkylene glycol ether with average molecular weight 2000 with block addition of oxyethylene units and oxypropylene units at molar ratio of 80/20 and 30 parts of polyalkylene glycol ether with average molecular weight 8000 with random addition of oxyethylene units and oxypropylene units at molar ratio of 20/80.

(P-2): Mixture of 50 parts of dodecyloxy polyalkylene glycol ether with average molecular weight 2000 with block addition of oxyethylene units and oxypropylene units at molar ratio of 80/20, 40 parts of butoxy polyalkylene glycol ether with average molecular weight 2500 with random addition of oxyethylene units and oxypropylene units at molar ratio of 40/60, and 10 parts of polyalkylene glycol ether with average molecular weight 11000 with block random addition of oxyethylene units and oxypropylene units at molar ratio of 40/60.

(P-3): Octoxy polyalkylene glycol ether with average molecular weight 1000 with random addition of oxyethylene units and oxypropylene units at molar ratio of 50/50.

TABLE 2-continued

| | Polyether Compound | | Straight-chain Polyether Modified Polyorgano-siloxane | | Ionic Surfactant | | Others | |
|---|---|---|---|---|---|---|---|---|
| | Kind | Amount | Kind | Amount | Kind | Amount | Kind | Amount |

(P-4): Methoxy polyalkylene glycol ether with average molecular weight 12000 with random addition of oxyethylene units and oxypropylene units at molar ratio of 25/75.

(MS-1)–(MS-4) and (PS-1)–(PS-3) are each straight-chain polyether modified polyorganosiloxane shown by Formula (1) and as explained in Table 3 wherein "B" indicates "block addition" and "R" indicates "random addition".

(QS-1)–(QS-5) are each quaternary onium salt shown by Formula (2) and as explained in Table 4.

(FN-1): Sodium isostearate.

(PA-1): Dibutylethanol amine salt of decyloxy polyethoxy (n = 4) ethylphosphate.

(ES-1): Octyl laurate (EE-1): Ester of octyloxypolyethoxylate (number of ethoxy units n = 5) and lauric acid (EE-2): Ester of octyloxypolyalkoxylate (polyalkoxylate being random connection of 5 ethoxy units and 3 propoxy units) and lauric acid.

(cr-1): Linear polydimethylsiloxane with average molecular weight 3000.

(cr-2): Linear polyorganosiloxane with 2 methyl-phenyl siloxane units and 20 dimethylsiloxane units connected linearly.

(cr-3): Pendant-type polyether modified polyorganosiloxane with 140 dimethyl siloxane units and 8 siloxane units having polyether groups randomly connected linearly by siloxane-bonding, the polyether groups each consisting of random connection of 80 oxyethylene units and 20 oxypropylene units.

(cr-4): Pendant-type polyether modified polyorganosiloxane with average molecular weight 8600, having dimethylsiloxane units and siloxane units with polyether groups randomly connected linearly by siloxane-bonding, polyether groups contained by 92 weight %, the polyether groups each consisting of random connection of 15 oxyethylene units and 15 oxypropylene units.

TABLE 3

| | Part inside [ ] | | | | | | | | | | | | |
|---|---|---|---|---|---|---|---|---|---|---|---|---|---|
| | Siloxane unit | | | | | | | | | | | | |
| | $R^1$ | $A^1O$ | p | B/R | $R^2$ | $R^5$ | m | $R^3$ | $OA^2$ | q | B/R | n | $R^4$ |
| MS-2 | OO | EO/PO = 10/10 | 35 | B | TM | M | 10 | TM | OE/OP = 10/10 | 35 | B | 1 | OO |
| PS-1 | BO | EO/PO = 30/30 | 60 | B | TEM | M | 10 | TEM | OE/OP = 30/30 | 60 | B | 2 | BO |
| PS-2 | AO | EO/PO = 15/45 | 60 | R | TM | M | 10 | TM | OE/OP = 15/45 | 60 | R | 2 | AO |
| PS-3 | BU | EO/PO = 80/20 | 100 | R | TEM | M | 10 | TEM | OE/OP = 80/20 | 100 | R | 7 | BU |

In Table 3:

OO: Octyloxy group

BO: Butoxy group

AO: Allyloxy group

BU: Butenyloxy group

EO: Ethoxy group

PO: Propoxy group

B/R: Block addition (B) or random addition (R)

TM: Trimethylene group

TEM: Tetramethylene group

M: Methyl group

γ: γ-trifluoropropyl group

F: Phenyl group

OE: Oxyethylene group

OP: Oxypropylene group

LR: Lauroyl group

TABLE 4

| | X | $R^6$ | $R^7$ | $R^8$ | $R^9$ | Compound which forms B | y |
|---|---|---|---|---|---|---|---|
| QS-1 | N | BT | BT | BT | M | Oleic acid | 1 |
| QS-2 | N | M | M | M | OC | Lauryl sulfonate | 1 |
| QS-3 | N | HOE | HOE | M | OY | Pentadecenyl succinic acid | 2 |
| QS-4 | P | BT | BT | BT | M | Tridecyl sulfonate | 1 |
| QS-5 | P | BT | BT | BT | BT | Isostearic acid | 1 |
| QS-6 | N | BT | BT | BT | M | Octylphenylethoxy ethylsulfate | 1 |

In Table 4:
BT: Butyl group
M: Methyl group
HOE: Hydroxyethyl group
OC: Octyl group
OY: Oleyl group

Part 2 (Application to Partially Drawn Polyester Filament Yarns)

Water was added to the agents prepared in Part 1 to obtain aqueous emulsions with concentration of agent 15%. After polyethylene terephthalate chips with intrinsic viscosity 0.64 and containing titanium oxide by 0.2% were dried by a usual method, an extruder was used for spinning at 295° C. The aqueous emulsions were applied by a roller oiling method to the traveling yarns after they were extruded from the spinneret and cooled to be hardened. They were wound up at the speed of 3300 m/minute without mechanical drawing to obtain wound 10 kg cakes of partially drawn 150-denier, 72-filament yarns with agents adhered at ratios shown in Tables 5 and 6.

These cakes were used to carry out false twisting by a continuous operation for 25 days of a contact heater type false twisting apparatus described below and the contamination of heater was evaluated. The results are shown in Tables 5 and 6.

Apparatus: SDS 1200B by Ernest Skrag and Sons, Inc.
Processing speed: 800 m/minute
Draw ratio: 1.522
Twisting system: Three-axis disk friction method (with one guide disk on entrance side, one guide disk on exit side and seven hard polyurethane disks)
Heater on twist side: Length=2.5 m and surface temperature=212° C.
Heater on untwisting side: None
Intended number of twisting: 3300 T/m After the 25-day continuous operation of the apparatus, the heater tar on the yarn path on the surface of the heater on the twist side was removed by a brush, collected and weighed. The weights were measured for ten spindles, and the results are shown as the average weight (mg) per spindle.

The cakes were also used to carry out false twisting by a continuous operation for 33 days of a short heater type false twisting apparatus described below and the contamination of heater ( or "heater deposits") was evaluated. The results are also shown in Tables 5 and 6.

Apparatus: No. 33J Mach Crimper by Murata Kikai, Inc.
Processing speed: 900 m/minute
Draw ratio: 1.522
Twisting system: Nip belt friction method
Heater on twist side: Length=1 m (with entrance part=30 cm and exit part=70cm) and surface temperature=480° C. at entrance part and 410° C. at exit part)
Heater on untwisting side: None
Intended number of twisting: 3300 T/m After the 33-day continuous operation of the apparatus, the sludge which became attached to the surface of the ceramic yarn path controlling guide was removed by a brush, collected and weighed. The results are shown as explained above for the case of the contact heater type.

TABLE 5

| Test Example No. | Agent used | Adhesion ratio (%) | Evaluation of heater contamination: Contact heater (mg) | Short heater (mg) |
|---|---|---|---|---|
| 21 | Test Example 2 | 0.4 | 84 | 18 |
| 22 | Test Example 3 | 0.4 | 79 | 15 |
| 23 | Test Example 4 | 0.4 | 79 | 16 |
| 24 | Test Example 5 | 0.4 | 60 | 6 |
| 25 | Test Example 6 | 0.4 | 75 | 10 |
| 26 | Test Example 7 | 0.4 | 82 | 17 |
| 29 | Test Example 10 | 0.8 | 85 | 18 |
| 38 | Test Example 19 | 0.3 | 68 | 13 |

TABLE 6

| Comparison Example No. | Agent used | Adhesion ratio (%) | Evaluation of heater contamination: Contact heater (mg) | Short heater (mg) |
|---|---|---|---|---|
| 17 | Comparison Example 1 | 0.4 | 540 | 190 |
| 18 | Comparison Example 2 | 0.4 | 510 | 180 |
| 19 | Comparison Example 3 | 0.4 | 500 | 205 |
| 20 | Comparison Example 4 | 0.4 | 555 | 185 |
| 21 | Comparison Example 5 | 0.4 | 1150 | 420 |
| 22 | Comparison Example 6 | 0.4 | 1030 | 395 |
| 23 | Comparison Example 7 | 0.4 | 670 | 310 |
| 24 | Comparison Example 8 | 0.4 | 705 | 340 |
| 25 | Comparison Example 9 | 0.4 | 580 | 305 |
| 26 | Comparison Example 10 | 0.4 | 1500 | 180 |
| 27 | Comparison Example 11 | 0.4 | 1200 | 445 |
| 28 | * | 0.4 | ** | ** |
| 28a | Comparison Example 16a | 0.4 | 258 | 186 |
| 28b | Comparison Example 16b | 0.4 | 204 | 159 |
| 28c | Comparison Example 16c | 0.4 | 218 | 175 |
| 28d | Comparison Example 16d | 0.4 | 1020 | 455 |
| 28e | Comparison Example 16e | 0.4 | 1110 | 480 |
| 28f | Comparison Example 16f | 0.4 | 560 | 214 |

In Tables 5 and 6:
Adhesion ratio: Amount (in %) of agent which became adhered to partially drawn yarn of polyester filaments.
*: Agent containing linear polydimethyl siloxane with viscosity $20 \times 10^{-6} m^2/s$ at 30° C., (MS-1) shown in Table 3 and potassium stearate at weight ratio of 96/2/2
**: Continued operation was not possible due to frequent occurrence of yarn breakage.

Part 3 (Application to Partially Drawn Nylon Filament Yarns)

Water was added to the agents prepared in Part 1 to obtain aqueous emulsions with concentration of agent 10%. After nylon-6,6 chips with sulfuric acid relative viscosity 2.4 containing titanium oxide by 0.1% were dried by a usual method, an extruder was used for spinning at 290° C. The aqueous emulsions were applied by a guide oiling method to the traveling yarns after they were extruded from the spinneret and cooled to be hardened. They were wound up at the speed of 4000 m/minute without mechanical drawing to obtain wound 8 kg cakes of partially drawn 70-denier, 24-filament yarns with agents adhered at ratios shown in Table 7.

The cakes thus obtained were used to carry out false twisting under the same conditions as in Part 2 except the following, and the contamination of the heater was evaluated also as done in Part 2.

Conditions for false twisting by a contact heater type false twisting apparatus:

Draw ratio: 1.220

Twisting system: Three-axis disk friction method (with one guide disk on entrance side, one guide disk on exit side and five ceramic disks)

Intended number of twisting: 3000 T/m

Conditions for false twisting by a short heat type false twisting apparatus:

Processing speed: 1000 m/minute

Draw ratio: 1.220

Heater on twist side: Surface temperature=475° C. at entrance part and 380° C. at exit part)

Intended number of twisting: 3000 T/m.

TABLE 7

| Example No. | Agent used | Adhesion ratio (%) | Evaluation of heater contamination: Contact heater (mg) | Evaluation of heater contamination: Short heater (mg) |
|---|---|---|---|---|
| Test Examples | | | | |
| 39 | Test Example 3 | 0.50 | 85 | 25 |
| 40 | Test Example 4 | 0.55 | 87 | 28 |
| 41 | Test Example 5 | 0.45 | 75 | 19 |
| 42 | Test Example 10 | 0.65 | 88 | 30 |
| 43 | Test Example 11 | 0.55 | 228 | 70 |
| Comparison Examples | | | | |
| 29 | Comparison Example 10 | 0.55 | 1450 | 200 |
| 30 | Comparison Example 11 | 0.55 | 1230 | 390 |
| 31 | Comparison Example 12 | 0.55 | 1080 | 405 |
| 32 | Comparison Example 13 | 0.55 | 760 | 305 |
| 33 | Comparison Example 14 | 0.55 | 595 | 300 |
| 34 | Comparison Example 15 | 0.55 | ** | ** |
| 35 | Comparison Example 16 | 0.55 | 1280 | 250 |

In Table 7:
Adhesion ratio: Amount (in %) of agent which became adhered to partially drawn yarns of polyester filaments.
**: Continued operation was not possible due to frequent occurrence of yarn breakage.

Part 4 (Application to Directly Spun Drawn Polyester Filament Yarns)

Water was added to the agents prepared in Part 1 to obtain aqueous emulsions with concentration of agent 10%. The emulsions were applied to the running yarns of polyester filaments by the guide oiling method and the yarns were wound up by means of a first godet roller rotating at the rate of 3000 m/minute, drawn mechanically between the second godet roller and wound up at the rate of 5000 m/minute to obtain wound 5 kg cakes of 75-denier, 36-filament directly spun drawn yarns with agents adhered at ratio of 0.35% with respect to the yarns.

The cakes thus obtained were used to carry out false twisting under the same conditions as in Part 2 except the overfeed ratio was 3% and the speed of false twisting process was 650 m/minute, and the contamination of the heater was evaluated also as done in Part 2. The results of evaluation are shown in FIG. 8.

TABLE 8

| Example No. | Agent used | Evaluation of heater contamination: Contact heater (mg) | Evaluation of heater contamination: Short heater (mg) |
|---|---|---|---|
| Test Examples | | | |
| 44 | Test Example 3 | 75 | 18 |
| 45 | Test Example 5 | 60 | 15 |
| 46 | Test Example 8 | 125 | 33 |
| 47 | Test Example 12 | 225 | 58 |
| Comparison Examples | | | |
| 36 | Comparison Example 5 | 880 | 440 |
| 37 | Comparison Example 7 | 665 | 380 |
| 38 | Comparison Example 9 | 585 | 340 |

It should be clear from the above that agents and methods according to the present invention are capable of sufficiently prevent the contamination of heaters for processing synthetic fibers even if the process is for false twisting including a severe heat treatment.

What is claimed is:

1. An agent for processing synthetic fibers, said agent comprising a polyether compound which has average molecular weight 700–20000 and is obtained by addition polymerization of alkylene oxide with 2–4 carbon atoms to a monohydric-hexahydric alcohol, a straight-chain polyether modified polyorganosiloxane shown by Formula (1) given below, and an ionic surfactant, containing said straight-chain polyether modified polyorganosiloxane in an amount of 0.1–12 weight % and said ionic surfactant in an amount of 0.1–12 weight %, said Formula (1) being:

Formula (1)

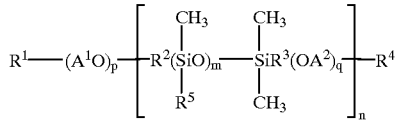

where $R^1$ and $R^4$ are each either alkoxy group with 1–10 carbon atoms or alkenoxy group with 2–10 carbon atoms; $R^2$ and $R^3$ are each alkylene group with 3 or 4 carbon atoms, $R^5$ is methyl group, $A^1$ and $A^2$ are each alkylene group with 2 or 3 carbon atoms, p and q are each an integer 20–150, m is an integer 5–20, and n is an integer 1–9; said ionic surfactant being quaternary onium salt given by:

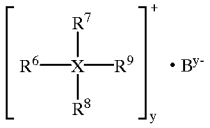

where X is N or P, $R^6$, $R^7$, $R^8$ and $R^9$ are each alkyl group with 1–25 carbon atoms, alkenyl group with 2–25 carbon atoms or hydroxyalkyl group with 1–6 carbon atoms, $B^{y-}$ is anion group of valence y obtained by removing hydrogen ions from a compound selected from the group consisting of acidic phosphoric acid esters with 1–30 carbon atoms, acidic sulfuric acid esters with 1–30 carbon atoms, acidic sulfonic acid esters with 1–30 carbon atoms and carboxylic acids with 1–30 carbon atoms, and y is an integer 1–3.

2. The agent of claim 1 wherein $B^{y-}$ is anion group of valence y obtained by removing hydrogen ions from a compound selected from the group consisting of acidic aliphatic phosphoric acid esters with 1–26 carbon atoms, acidic aliphatic sulfonic acid esters with 1–26 carbon atoms and aliphatic carboxylic acids with 1–26 carbon atoms.

3. The agent of claim 1 further containing ester compound and/or ether ester compound with total number of carbon atoms 10–50 in an amount of 1–30 weight %.

4. A method of processing synthetic fibers which are subjected to a heat treatment, said method comprising the step of applying an agent to said synthetic fibers at a ratio of 0.1–3 weight % with respect to said synthetic fibers, said agent comprising a polyether compound which has average molecular weight 700–20000 and is obtained by addition polymerization of alkylene oxide with 2–4 carbon atoms to monohydric-hexahydric alcohol, a straight-chain polyether modified polyorganosiloxane shown by Formula (1) given below, and an ionic surfactant, containing said straight-chain polyether modified polyorganosiloxane in an amount of 0.1–12 weight % and said ionic surfactant in an amount of 0.1–12 weight %, said Formula (1) being:

Formula (1)

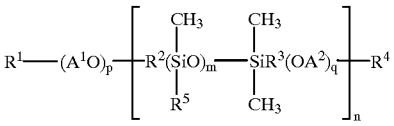

where $R^1$ and $R^4$ are each either alkoxy group with 1–10 carbon atoms or alkenoxy group with 2–10 carbon atoms; $R^2$ and $R^3$ are each alkylene group with 3 or 4 carbon atoms, $R^5$ is methyl group, $A^1$ and $A^2$ are each alkylene group with 2 or 3 carbon atoms, p and q are each an integer 20–150, m is an integer 5–20, and n is an integer 1–9; said ionic surfactant being quaternary onium salt given by:

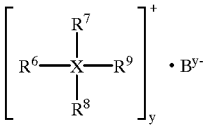

where X is N or P, $R^6$, $R^7$, $R^8$ and $R^9$ are each alkyl group with 1–25 carbon atoms, alkenyl group with 2–25 carbon atoms or hydroxyalkyl group with 1–6 carbon atoms, $B^{y-}$ is anion group of valence y obtained by removing hydrogen ions from a compound selected from the group consisting of acidic phosphoric acid esters with 1–30 carbon atoms, acidic sulfuric acid esters with 1–30 carbon atoms, acidic sulfonic acid esters with 1–30 carbon atoms and carboxylic acids with 1–30 carbon atoms, and y is an integer 1–3.

5. The method of claim 4 wherein said agent further contains ester compound and/or ether ester compound with total number of carbon atoms 10–50 in an amount of 1–30 weight %.

6. The method of claim 4 further comprising the step of subjecting said synthetic fibers to a false twisting process.

7. The method of claim 6 wherein said false twisting process is carried out by a short heater operating at 300–600° C.

* * * * *